US011839828B2

(12) United States Patent
Lin

(10) Patent No.: US 11,839,828 B2
(45) Date of Patent: Dec. 12, 2023

(54) PORTABLE RIDE-ON TOY

(71) Applicant: Stallion Sport Limited, Kowloon (HK)

(72) Inventor: Joseph Lin, Carson, CA (US)

(73) Assignee: Stallion Sport Limited, Hong Kong (HK)

( * ) Notice: Subject to any disclaimer, the term of this patent is extended or adjusted under 35 U.S.C. 154(b) by 69 days.

(21) Appl. No.: 17/530,217

(22) Filed: Nov. 18, 2021

(65) Prior Publication Data

US 2023/0149820 A1 May 18, 2023

(51) Int. Cl.
*A63G 19/18* (2006.01)

(52) U.S. Cl.
CPC ..... *A63G 19/18* (2013.01)

(58) Field of Classification Search
CPC ..... A63G 19/18; B62B 3/002; B60K 9/00; A63B 2225/62
See application file for complete search history.

(56) References Cited

U.S. PATENT DOCUMENTS 2,627,419 A * 2/1953 Lindenbein ..... A63G 19/02 280/1.206
3,065,567 A * 11/1962 Lemelson ..... A63H 29/16 446/226
4,023,816 A * 5/1977 Ellman ..... A63G 19/00 280/1.13
4,037,833 A * 7/1977 Anderson ..... A63G 23/00 280/1.13
6,039,327 A * 3/2000 Spector ..... A63G 19/18 280/1.13
6,679,750 B1 * 1/2004 Nielsen ..... A63H 33/04 446/85
6,773,330 B1 * 8/2004 Cohen ..... A63H 3/06 446/369
8,469,369 B1 * 6/2013 McCarthy ..... B62K 9/00 280/282
D798,620 S * 10/2017 Liu ..... D6/345
10,245,517 B2 * 4/2019 Cyr ..... A63H 17/38
11,066,134 B1 * 7/2021 Dial, III ..... B63B 34/52
2005/0233676 A1 * 10/2005 Bohart ..... A63H 3/06 446/313
2009/0209166 A1 * 8/2009 Chen ..... B62K 9/00 446/96

* cited by examiner

*Primary Examiner* — Jason D Shanske
*Assistant Examiner* — James J Triggs
(74) *Attorney, Agent, or Firm* — Raymond Sun

(57) ABSTRACT

A ride-on toy has a base having a front piece and a rear piece, each of the front piece and the rear piece having a plurality of leg housings. The base further includes at least one connecting strap that removably connects the front piece and the rear piece. The ride-on toy also includes an inflatable body having a body portion and a plurality of legs, with each of the plurality of legs inserted into a corresponding one of the plurality of leg housings. The ride-on toy also includes a plurality of wheel holders, each wheel holder having a foot housing and an ankle section extending upwardly from the foot housing, with a rotatable wheel secured inside the foot housing, and with the ankle section inserted into a corresponding one of the plurality of leg housings.

8 Claims, 11 Drawing Sheets

PORTABLE RIDE-ON TOY

BACKGROUND OF THE INVENTION

1. Field of the Invention

The present invention relates to ride-on toys, and more particularly relates to a ride-on toy that can be assembled from a number of components that can be stored in a smaller package for storage or transportation.

2. Description of the Prior Art

Ride-on toys are very popular among children. Most ride-on toys are provided in their "use" state where they are ready for a user to sit on, and ride the toy. Unfortunately, in such a use configuration, these toys can be bulky and large, which makes it inconvenient for storage and transportation.

Thus, there remains a need for a ride-on toy that can be conveniently stored and transported, and which is easy to use.

SUMMARY OF THE DISCLOSURE

It is an object of the present invention to provide a ride-on toy that can be assembled from a number of smaller components so that all these components can be packaged into a smaller package or box for convenient storage and transportation.

In order to accomplish the objects of the present invention, there is provided a ride-on toy having a base having a front piece and a rear piece, each of the front piece and the rear piece having a plurality of leg housings. The base further includes at least one connecting strap that removably connects the front piece and the rear piece. The ride-on toy also includes an inflatable body having a body portion and a plurality of legs, with each of the plurality of legs inserted into a corresponding one of the plurality of leg housings. The ride-on toy also includes a plurality of wheel holders, each wheel holder having a foot housing and an ankle section extending upwardly from the foot housing, with a rotatable wheel secured inside the foot housing, and with the ankle section inserted into a corresponding one of the plurality of leg housings.

The front and rear pieces of the base, the connecting strap(s), the inflatable body, and the wheel holders are provided as separate components that can be assembled together or taken apart for storage and transportation. This allows the overall assembly to be provided in smaller-sized pieces to facilitate a smaller overall package or box, and lighter-weight to reduce manufacturing and shipping costs.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a ride-on toy that can be quickly and conveniently assembled together for use. This ride-on toy can be provided in a smaller package or configuration that is convenient for storage and transportation, and then assembled into its larger use configuration.

The ride-on toy has a base 102, an inflatable body 104, and a plurality of detachable wheel holders 106. Each of these components can be provided separately and then assembled quickly for use.

Figure 1:
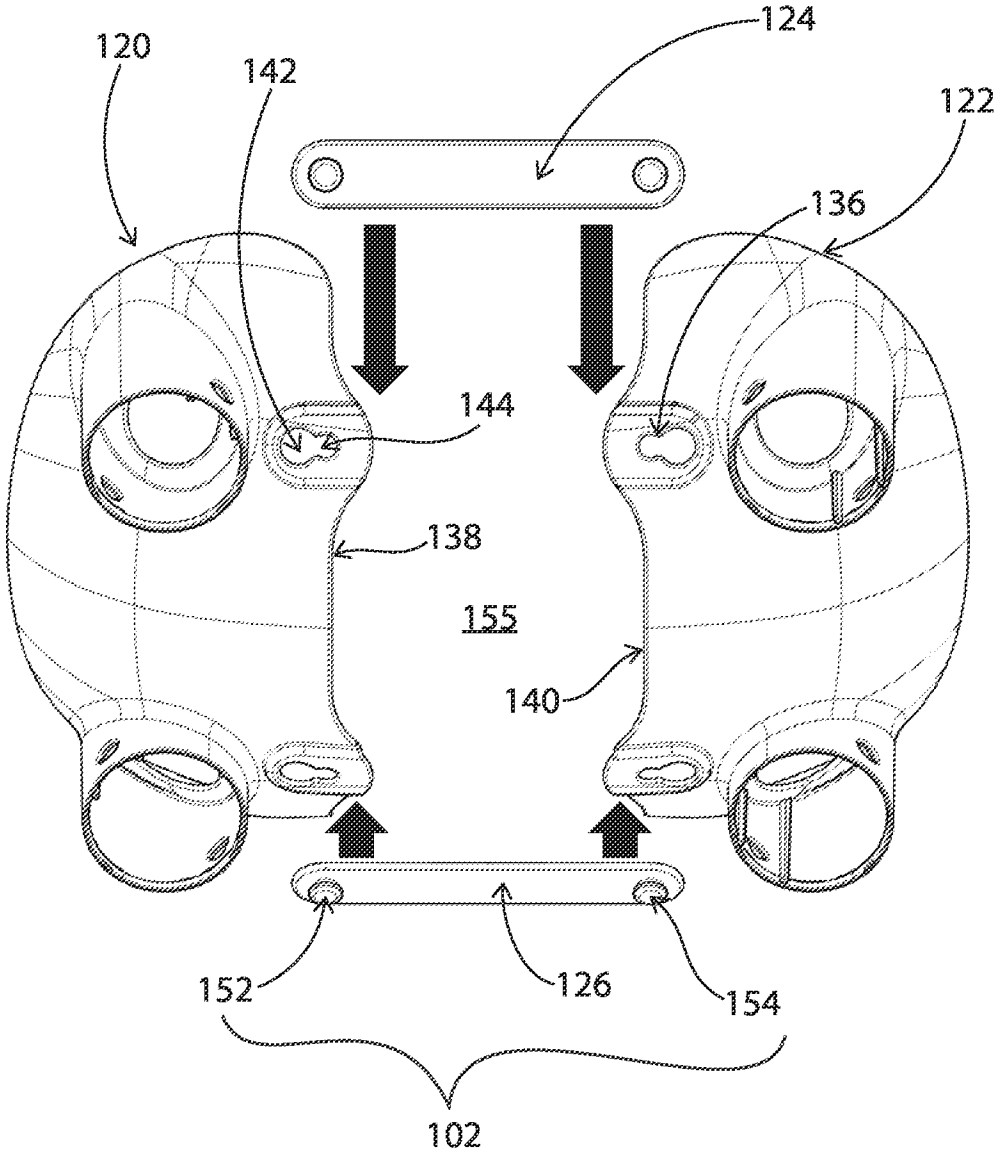
FIG. 1 is an exploded perspective view of the base for a ride-on toy according to one embodiment of the present invention.
Figure 2:
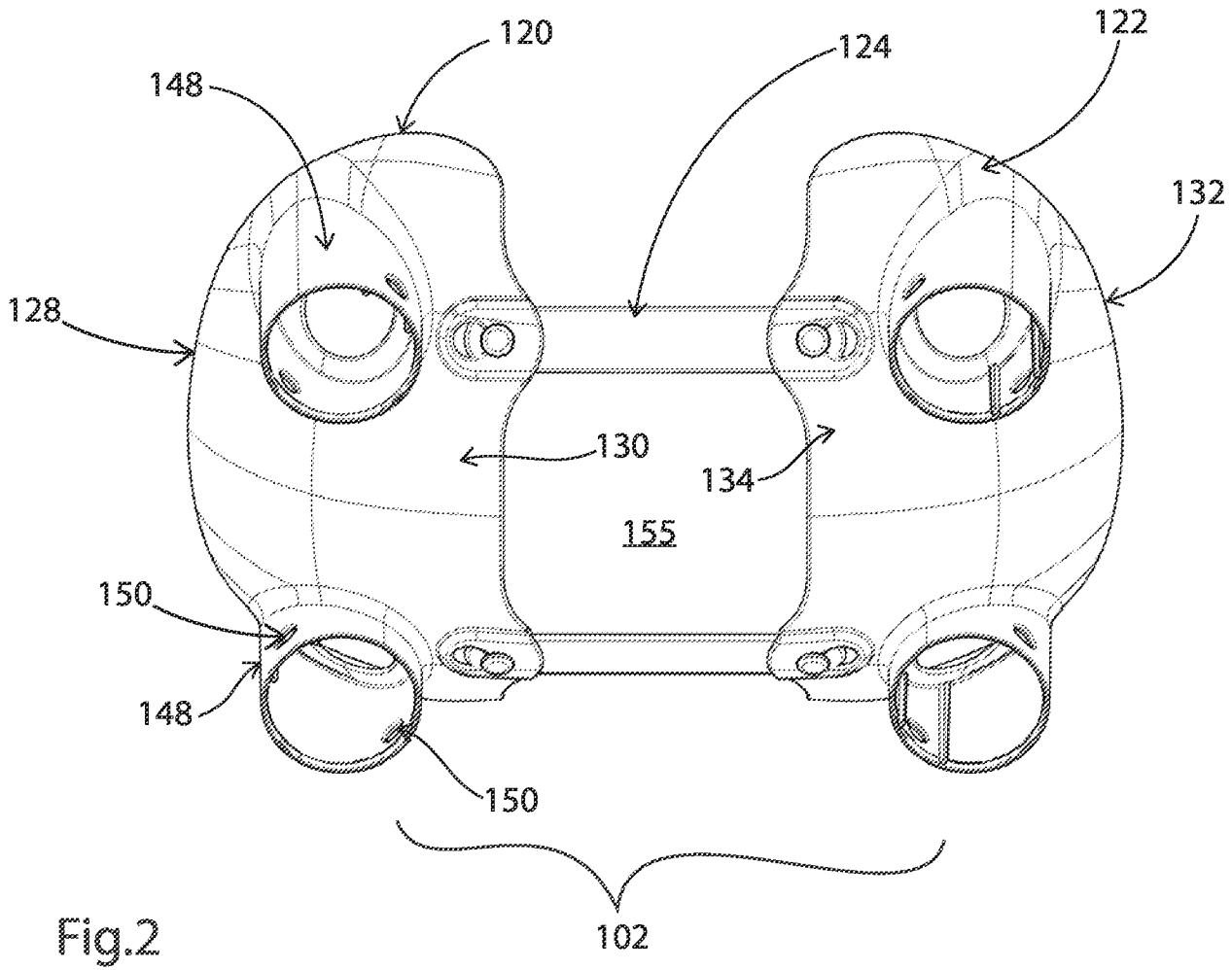
FIG. 2 is a perspective view of the assembled base of FIG. 1.

Referring to FIGS. 1-2, the base 102 has a front piece 120 and a rear piece 122 that are removably coupled by two connecting straps 124 and 126. In one embodiment, the front piece 120 and the rear piece 122 can be identical, with each piece 120 or 122 used as either the front or the rear piece. The front piece 120 has a generally concave configuration with a front wall 128 and a bottom wall 130, and the rear piece 122 is also generally concave with a rear wall 132 and a bottom wall 134. As mentioned above, the front wall 128 can be the same as the rear wall 132. Each of the bottom walls 130 and 134 has two pear-shaped openings 136 adjacent the inner edge 138 and 140, respectively, thereof. Each pear-shaped opening 136 defines two generally circular openings, with a larger opening 142 and a smaller opening 144. Each of the front piece 120 and the rear piece 122 has two vertical and cylindrical leg housings 148. Aligned openings 150 are provided in the annular wall of each leg housing 148.

Each connecting strap 124, 126 is elongated in configuration, and has two tabs 152 and 154 provided at opposite ends. The two connecting straps 124, 126 are used to connect the front piece 120 and the rear piece 122, and can be identical. Specifically, each tab 152 and 154 is inserted through a separate pear-shaped opening 136 in one of the two pieces 120, 122. Referring to FIG. 1, the tab 152 is inserted through the larger opening 142 in the pear-shaped opening 136 of the front piece 120, and the tab 154 is inserted through the larger opening 142 in the pear-shaped opening 136 of the rear piece 122. The two tabs 152 and 154 are then moved to the smaller opening 144 in the two pear-shaped openings 136 to lock or secure the connection. FIG. 2 shows the two connecting straps 124, 126 securing the two pieces 120, 122 together.

As best shown in FIGS. 1-2, a space 155 is defined between the two pieces 120, 122. In a conventional ride-on toy, the base would extend from the front to the rear, so that by providing the space 155, the present invention actually reduces the amount of material required for the base 102, which provides the following benefits: (i) lower cost as less material is needed, (ii) lighter weight as there is less material, and (iii) the two separate pieces 120, 122 allow for the size of the base 102 to be reduced into the individual sizes of the two separate pieces 120, 122.

Figure 3:
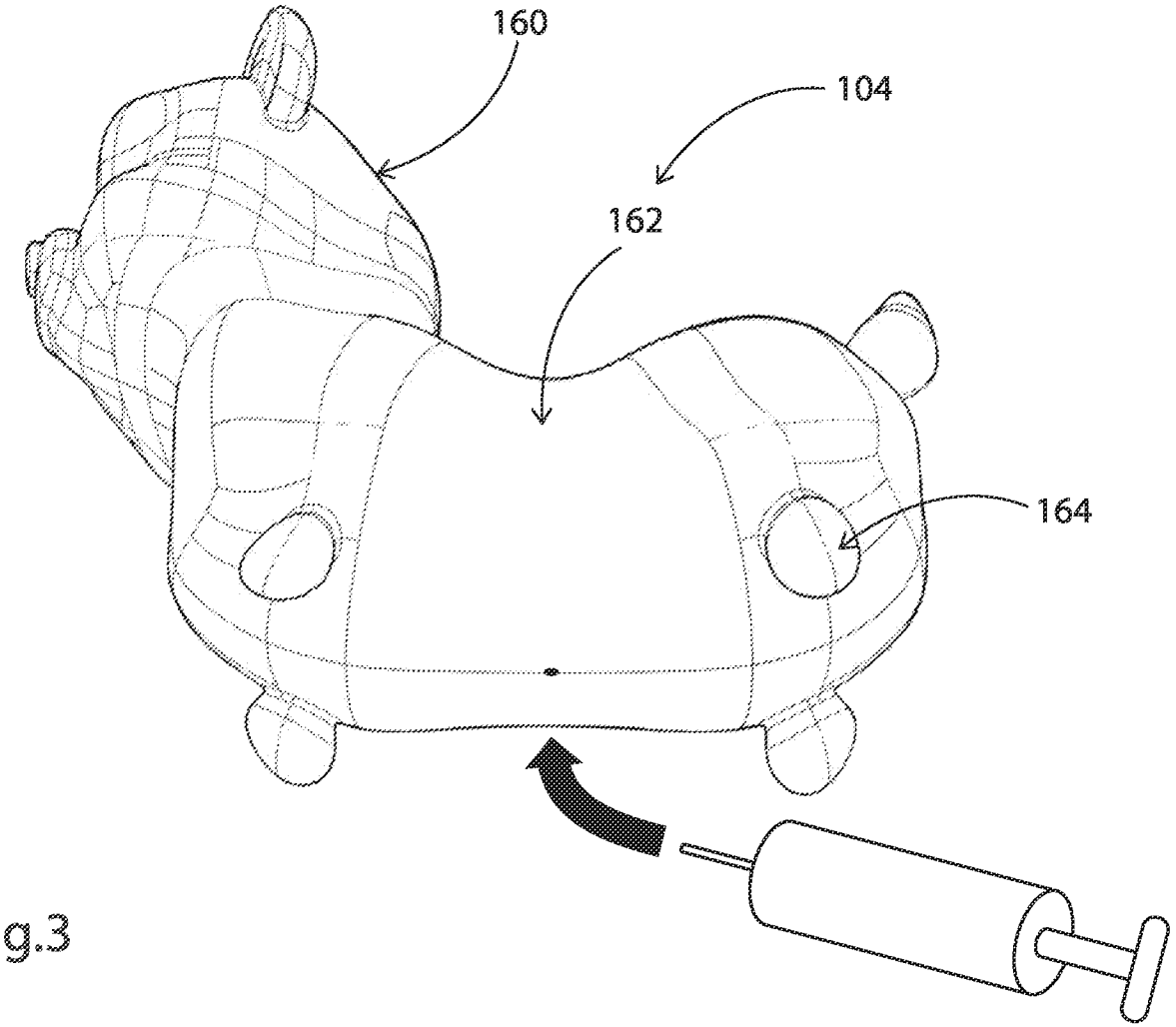
FIG. 3 is an exploded perspective view of a body for a ride-on toy according to one embodiment of the present invention.

FIG. 3 shows the inflatable body 104, which can be configured to be an animal having a head 160, a body portion 162, and four legs 164. The inflatable body 104 can be inflated to be half-full of air. The inflatable body 104 needs to be inflated half-full so that the legs 164 are still flexible enough to be squeezed and pushed into a separate leg housing. If the body 104 is not inflated at all, it cannot be assembled because it is too soft. If the body is fully inflated, the legs 164 will be too hard to be inserted into the leg housings.

Figure 4:
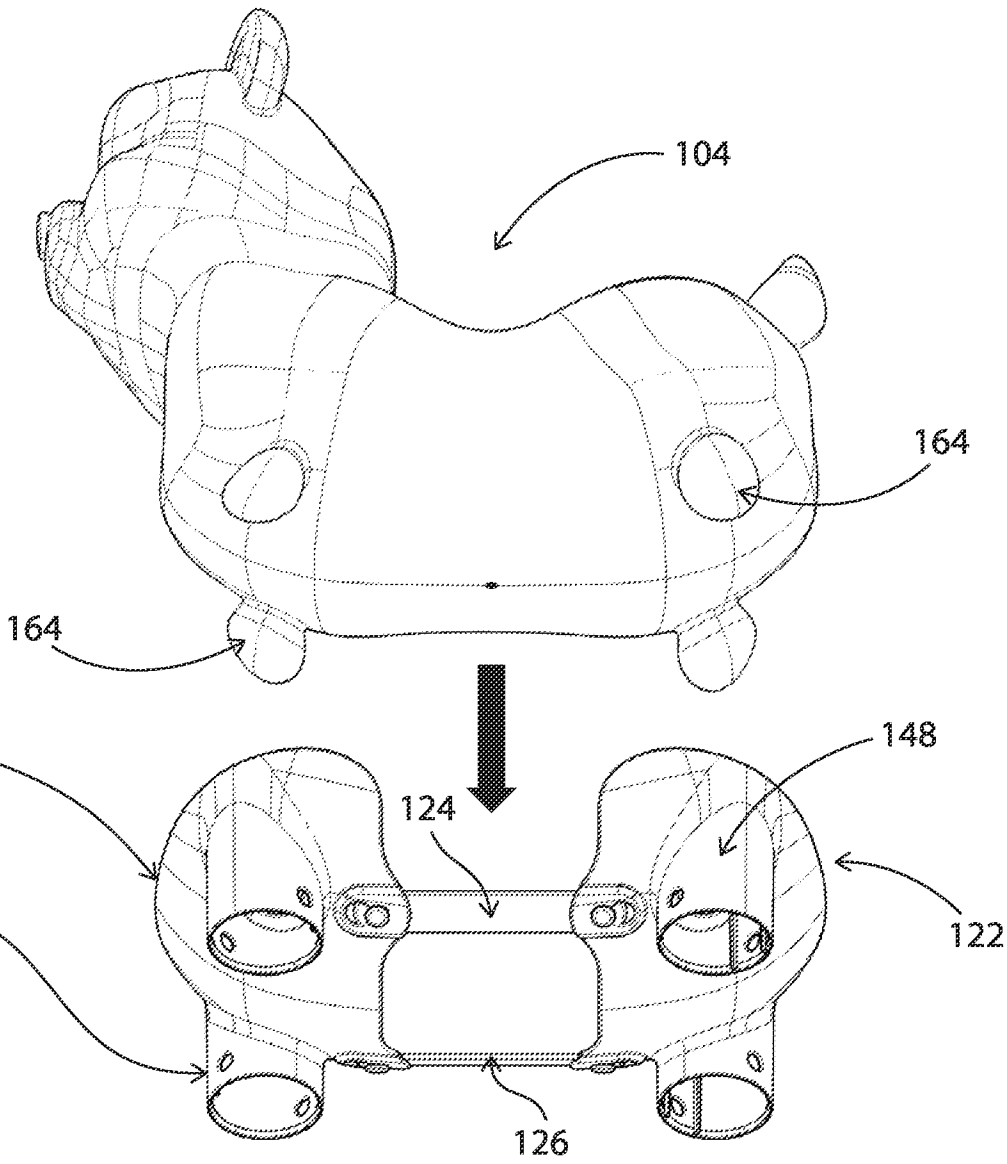
FIG. 4 is an exploded perspective view of the body of FIG. 3 and the base of FIG. 2.
Figure 5:
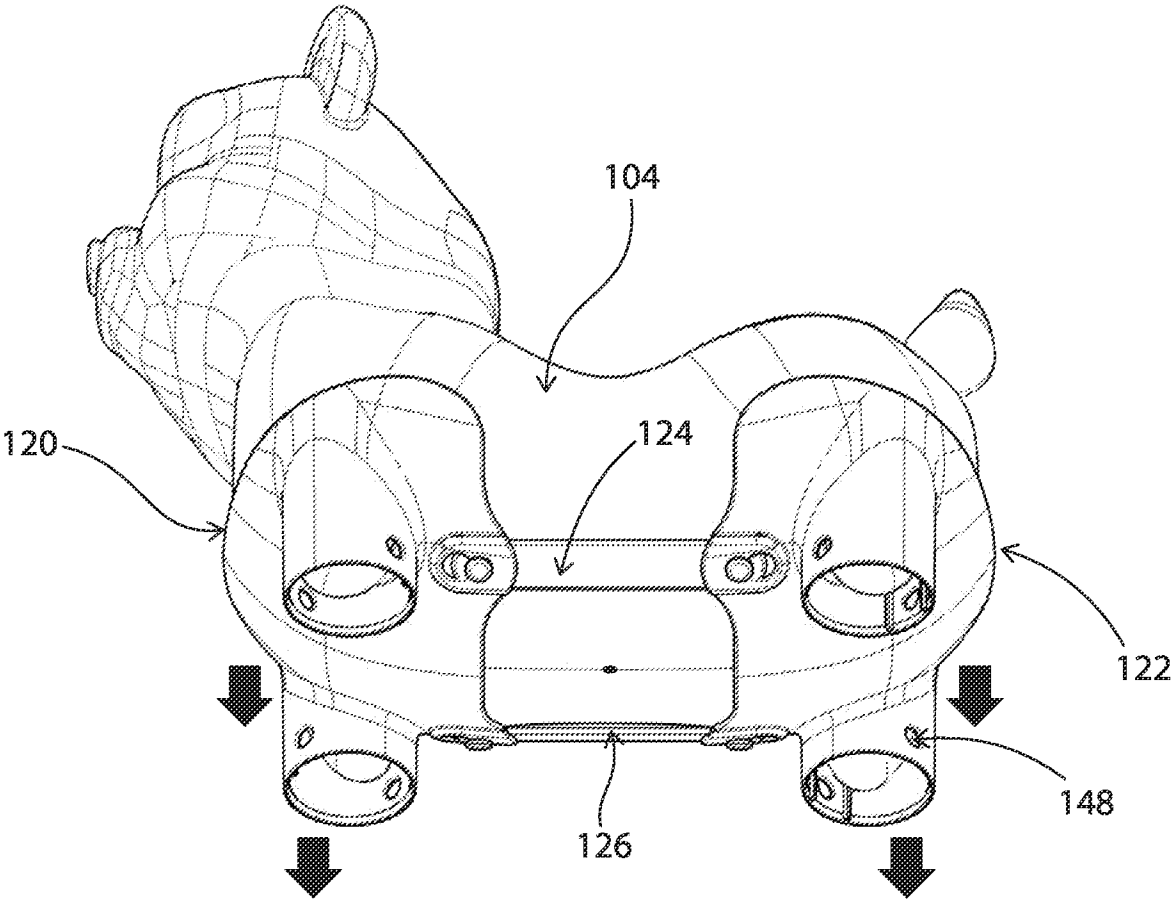
FIG. 5 is a perspective view of the base and the body of FIG. 4 shown assembled together.
Figure 6:
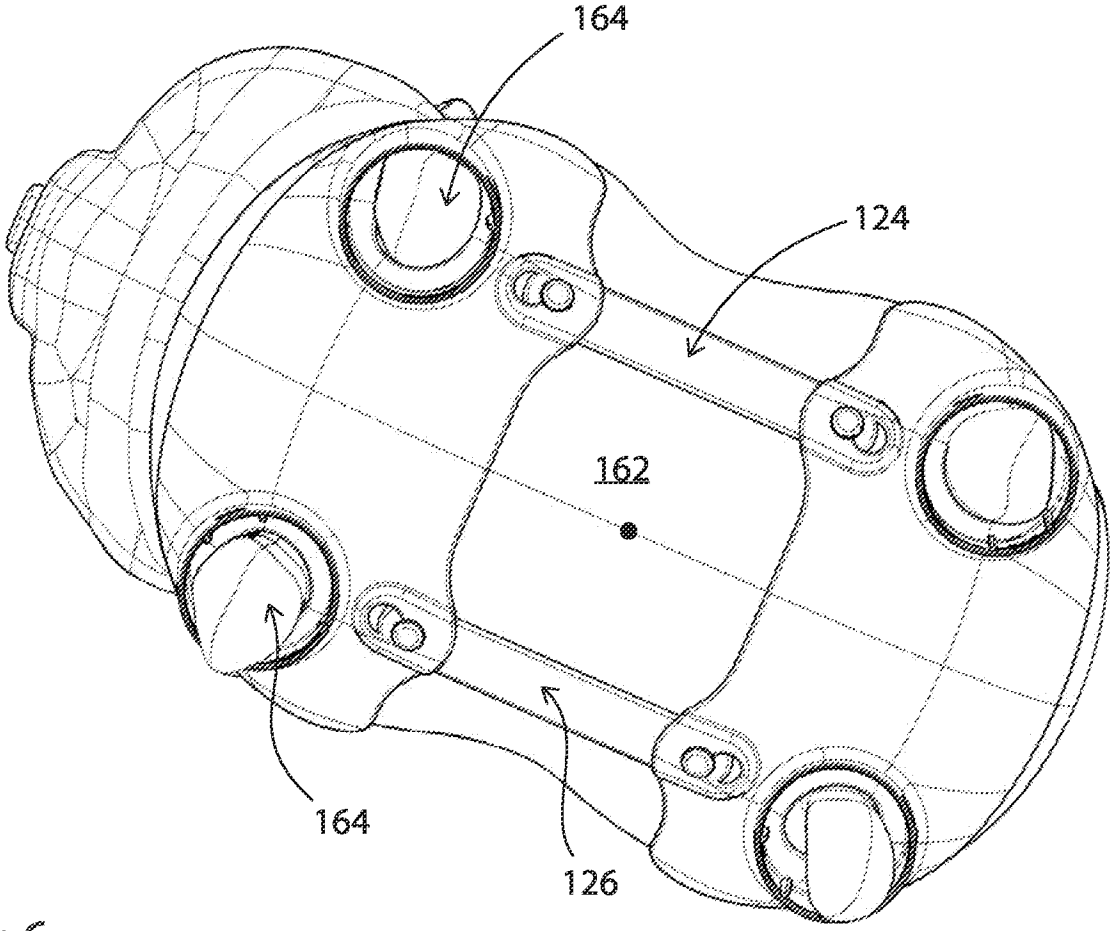
FIG. 6 is a bottom perspective view of FIG. 5.

Next, in FIG. 4, the half-inflated body 104 is inserted into the space defined by the two pieces 120, 122, and each of the legs 164 of the half-inflated body 104 is inserted into a separate leg housing 148, and pulled to extend through most of the corresponding leg housing 148. FIGS. 5 and 6 show the resulting assembly of the half-inflated body 104 to the base 102.

Figure 7:
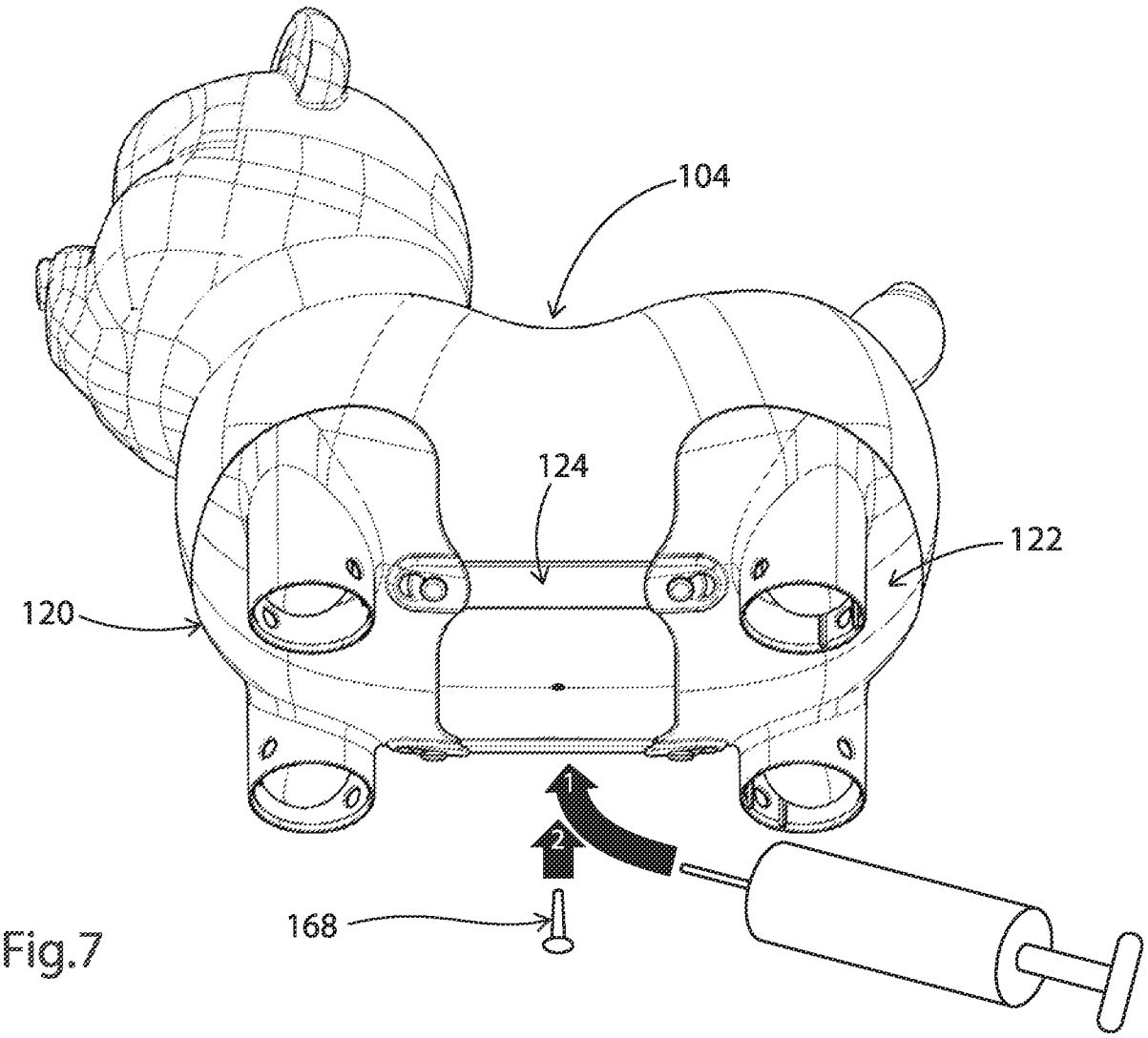
FIG. 7 illustrates the inflation of the body of FIG. 5.
Figure 8:
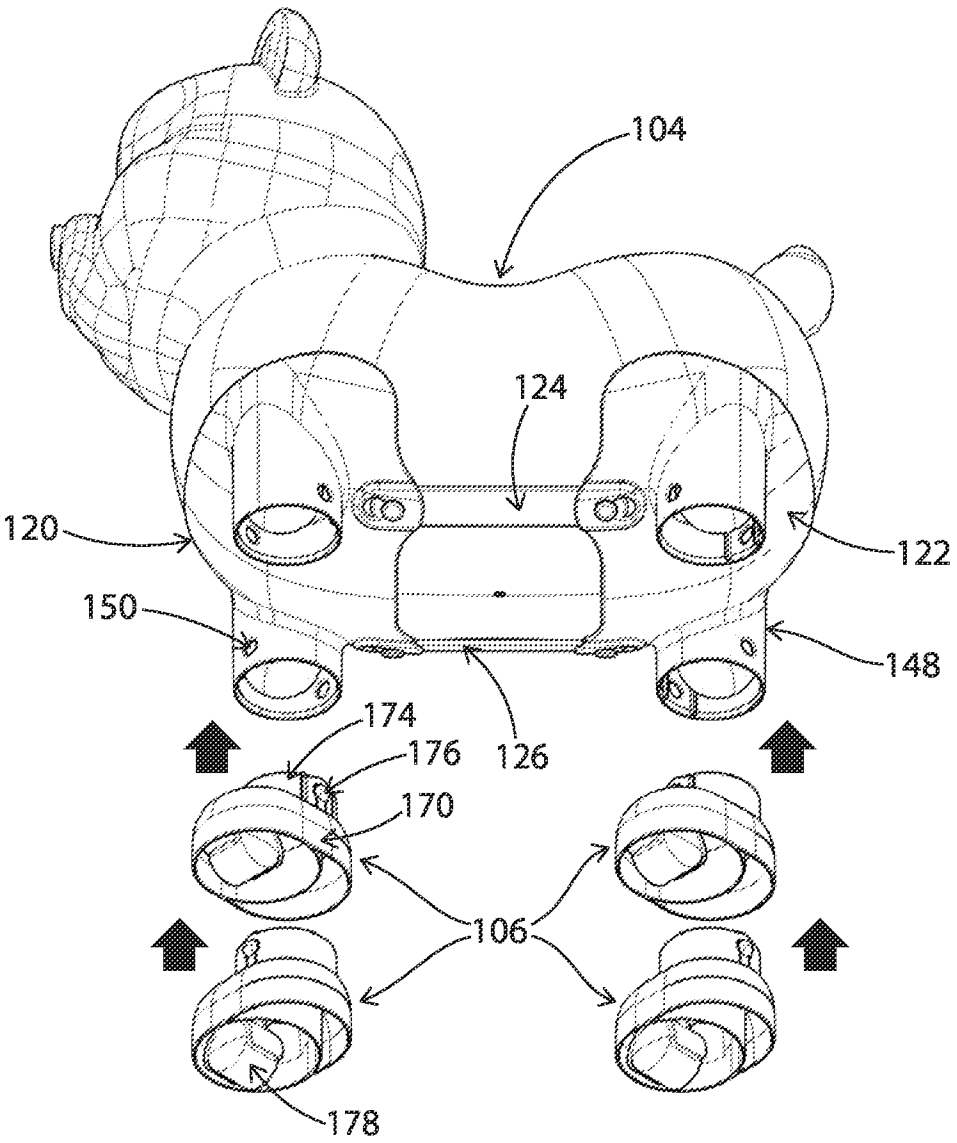
FIG. 8 is an exploded perspective view showing wheel holders being assembled to the body in FIG. 5.

As shown in FIG. 7, the body 104 is then inflated to its fully inflated size and configuration, and a pin 168 is inserted to seal in the internal bladder of the body 104 to prevent the escape of air.

Figure 9:
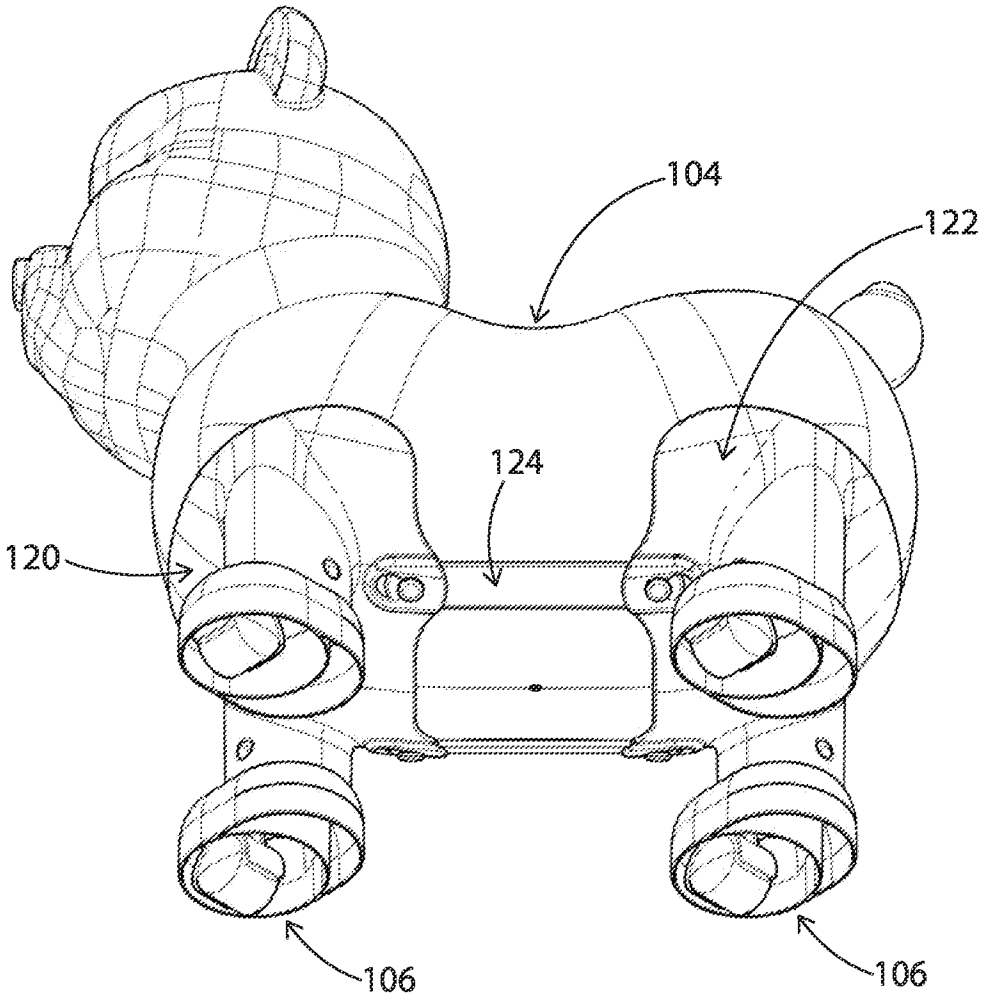
FIG. 9 is a bottom perspective view of a fully-assembled ride-on toy of FIGS. 1-8.
Figure 10:
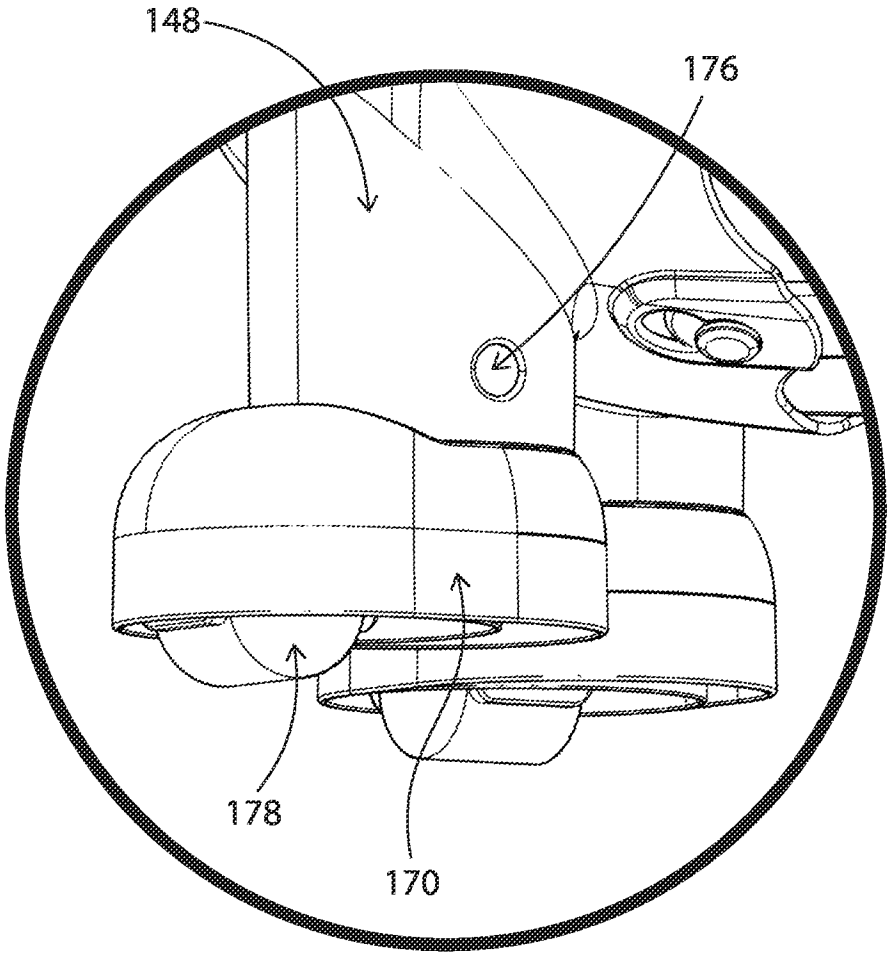
FIG. 10 is an enlarged view showing a wheel holder secured to a leg housing.
Figure 11:
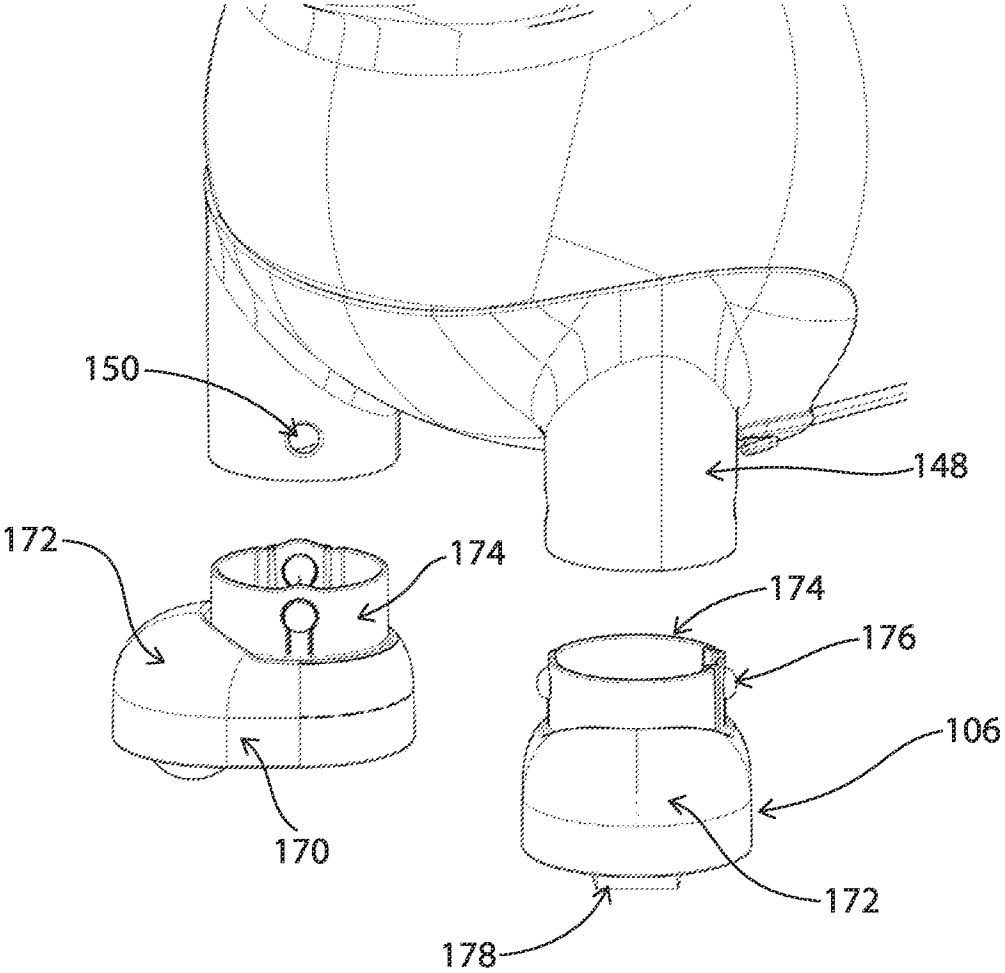
FIG. 11 is exploded expanded perspective view showing two wheel holders being secured to the two front leg housings.

Referring to FIGS. 8-11, the wheel holders 106 are inserted into each leg housing 148. While the wheel holders 106 are shown to be identical in the drawings, it is possible to configure the wheel holders differently. For example, the front wheel holders can be different from the rear wheel holders. In this embodiment, each wheel holder 106 has an elongated foot housing that is configured like a foot with a surrounding wall 170 and a top part 172. An annular ankle section 174 extends upwardly from the surrounding wall 170, and two pressable lock buttons 176 are provided opposite each other along the ankle section 174. A rotatable wheel 178 is fixed inside the shoe in the space defined by the wall 170 and the top part 174. To secure a wheel holder 106 at a leg housing 148, the ankle section 174 is inserted into the leg housing 148 from the bottom thereof. The lock buttons 176 will slide against the inner wall of the leg housing 148 and be snap-fitted into the aligned openings 150. See FIG. 8 and FIG. 9. FIG. 9 shows the fully assembled ride-on toy 100 that is ready for use. Because the body 104 is fully inflated, the legs 164 will become larger than the upper opening inside the leg housing 148, and therefore be secured inside the leg housing 148.

To dis-assemble the ride-on toy 100, the user can press the two locking buttons 176 simultaneously and remove the ankle sections 174 from the four leg housings 148. After removing the pin 168, the body 104 is deflated, and then removed from the pieces 120, 122. The connecting straps 124 and 126 are then detached from the pieces 120, 122 by sliding the tabs 152 and 154 from the smaller openings 144 to the larger openings 142. The separate components can then be packed away in a smaller package or container.

Thus, the present invention provides a ride-on toy 100 that can be quickly and conveniently assembled for use, and quickly and conveniently taken apart and stored in a smaller package or container.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A ride-on toy, comprising:

a base having a front piece and a rear piece, each of the front piece and the rear piece having at least one leg housing, further including a connecting strap that removably connects the front piece and the rear piece and is positioned below the front piece and the rear piece;

an inflatable body having a body portion and a plurality of legs, with each of the plurality of legs inserted into a corresponding one of the leg housings in the front piece and the rear piece; and a plurality of wheel holders, each wheel holder having a foot housing and an ankle section extending upwardly from the foot housing, with a rotatable wheel secured inside the foot housing, and with the ankle section inserted into a corresponding one of the leg housings.

2. The ride-on toy of claim 1, wherein the front piece and the rear piece each has an inner edge, and wherein a space is defined between the inner edges of the front piece and the rear piece.

3. The ride-on toy of claim 1, wherein the front piece and the rear piece each has a concave configuration, with an inner edge, and an opening provided adjacent the inner edge.

4. The ride-on toy of claim 1, wherein the front piece and the rear piece each has two vertical and cylindrical leg housings, each leg housing having an annular wall, and wherein aligned openings are provided in the annular wall of each leg housing.

5. The ride-on toy of claim 3, wherein the connecting strap is elongated in configuration, and has first and second tabs provided at opposite first and second ends, wherein the first tab is inserted through the opening in the front piece, and the second tab is inserted through the opening in the rear piece.

6. A ride-on toy, comprising:

a base having a front piece and a rear piece, each of the front piece and the rear piece having at least one leg housing, further including a connecting strap that removably connects the front piece and the rear piece;

an inflatable body having a body portion and a plurality of legs, with each of the plurality of legs inserted into a corresponding one of the leg housings in the front piece and the rear piece; and a plurality of wheel holders, each wheel holder having a foot housing and an ankle section extending upwardly from the foot housing, with a rotatable wheel secured inside the foot housing, and with the ankle section inserted into a corresponding one of the leg housings;

wherein two pressable lock buttons are provided opposite each other along the ankle section.

7. The ride-on toy of claim 6, wherein the foot housing of each wheel holder defines a surrounding wall and a top part.

8. A ride-on toy, comprising:

a base having a front piece and a rear piece, each of the front piece and the rear piece having a concave configuration, an inner edge, a tab opening provided adjacent the inner edge, and two vertical and cylindrical leg housings, wherein each leg housing has an annular wall, with aligned openings provided in the annular wall of each leg housing;

an elongated connecting strap that removably connects the front piece and the rear piece, and having first and second tabs provided at opposite first and second ends, wherein the first tab is inserted through the tab opening in the front piece, and the second tab is inserted through the tab opening in the rear piece;

an inflatable body having a body portion and a plurality of legs, with each of the plurality of legs inserted into a corresponding one of the leg housings in the front piece and the rear piece; and a plurality of wheel holders, each wheel holder having a foot housing and an ankle section extending upwardly from the foot housing, with a rotatable wheel secured inside the foot housing, wherein the ankle section is inserted into a corresponding one of the leg housings, and two pressable lock buttons are provided opposite each other along the ankle section;

wherein a space is defined between the inner edges of the front piece and the rear piece.

* * * * *